US008250947B2

(12) United States Patent
Hu

(10) Patent No.: US 8,250,947 B2
(45) Date of Patent: Aug. 28, 2012

(54) RATCHET WRENCH

(76) Inventor: Bobby Hu, Taichung (TW)

( * ) Notice: Subject to any disclaimer, the term of this patent is extended or adjusted under 35 U.S.C. 154(b) by 304 days.

(21) Appl. No.: 12/778,245

(22) Filed: May 12, 2010

(65) Prior Publication Data

US 2011/0048179 A1 Mar. 3, 2011

(30) Foreign Application Priority Data

Aug. 31, 2009 (TW) ..... 98129318 A

(51) Int. Cl.
*B25B 13/46* (2006.01)

(52) U.S. Cl. ..... 81/63.1; 81/62

(58) Field of Classification Search ..... 81/60, 62, 81/63.1

See application file for complete search history.

(56) References Cited

U.S. PATENT DOCUMENTS

| | | | | |
|---|---|---|---|---|
| 6,279,428 | B1 * | 8/2001 | Huang | 81/63.1 |
| 7,278,339 | B2 | 10/2007 | Hu | 81/63.2 |
| 7,299,720 | B1 * | 11/2007 | Schultz et al. | 81/63.1 |
| 7,661,337 | B2 * | 2/2010 | Chen | 81/62 |
| 7,802,498 | B2 * | 9/2010 | Hu | 81/63.1 |
| 7,827,886 | B2 * | 11/2010 | Hu | 81/63.1 |
| 7,836,798 | B2 * | 11/2010 | Hu | 81/63.1 |
| 7,895,921 | B2 * | 3/2011 | Huang | 81/63.1 |
| 7,921,751 | B2 * | 4/2011 | Hu | 81/63.1 |
| 7,975,574 | B2 * | 7/2011 | Hu | 81/63.1 |
| RE42,768 | E * | 10/2011 | Huang | 81/62 |
| 2005/0257650 | A1 * | 11/2005 | Hu | 81/63.1 |
| 2008/0006125 | A1 * | 1/2008 | Chen | 81/63.1 |
| 2009/0314139 | A1 * | 12/2009 | Hu | 81/63.1 |
| 2010/0018356 | A1 * | 1/2010 | Hu | 81/63.1 |
| 2010/0018357 | A1 * | 1/2010 | Hu | 81/63.1 |
| 2010/0031783 | A1 * | 2/2010 | Hu | 81/63.1 |
| 2010/0037735 | A1 * | 2/2010 | Hu | 81/62 |
| 2010/0288082 | A1 * | 11/2010 | Huang | 81/63.1 |

* cited by examiner

*Primary Examiner* — David B Thomas
(74) *Attorney, Agent, or Firm* — Alan Kamrath; Kamrath IP Lawfirm, PA

(57) ABSTRACT

A ratchet wrench includes a head having a compartment. The compartment includes a first compartment section rotatably receiving a drive member and a second compartment section slideably receiving two pawls releasably engaged with the drive member. A switch is rotatably received in a switch groove formed in a side of the head and in communication with the second compartment section. A reversing plate is rotatably mounted to an engaging portion of the drive member extending beyond the head. The reversing plate includes a control section having a guiding groove. The switch includes a pin slideably engaged in the guiding groove. The switch pivots in the switch groove with the pin sliding in the guiding groove when the reversing plates pivots to control engagement between the drive member and the first and second pawls for controlling a driving direction of the ratchet wrench.

12 Claims, 10 Drawing Sheets

RATCHET WRENCH

BACKGROUND OF THE INVENTION

The present invention relates to a ratchet wrench and, more particularly, to a ratchet wrench providing reliable, direct driving direction-switching operation and reliable positioning effect.

U.S. Pat. No. 7,278,339 discloses a reversible ratchet wrench including a head rotatably receiving a drive member. A pawl is slideably received in the head between two positions and releasably engages with the drive member. A ring is mounted around an end of the drive member and includes a tip piece having a slot. A reversing plate is pivotably mounted to the end of the drive member and operatively connected to the ring to turn therewith. A switching member is pivotably received in a receiving hole of the head and includes a protrusion engaged in the slot of the tip piece of the ring such that the switching member is pivoted when the ring is pivoted. The switching member includes a receptacle receiving an elastic element and a pressing member biased by the elastic element to press against the pawl. The reversing plate is pivotable between two operative positions to move the pawl between the two positions to switch the driving direction of the ratchet wrench. However, friction between the ring and the reversing plate causes wear and generates scraps between the ring and the reversing plate. Furthermore, a positioning structure including a pin and a pin hole is required for positioning the reversing plate, leading to an increase in the manufacturing costs as well as adverse affect in the positioning effect due to accumulation of dust in the gaps between the positioning elements. Further, there are many elements between the reversing plate and the switching member with each element having its own play, leading to unreliable driving direction-switching operation. Further, a user may work with his or her head facing upward in some cases. Direction-switching operation may be a problem in these cases when a socket or an extension is coupled to a drive column of the drive member that faces upward, because gravitational force is imparted to the drive member from the socket, the extension or even the object to be the rotated by the ratchet wrench. The user has to remove the socket or extension from the drive column, flips the drive member so that the drive column faces downward, switches the driving direction, and reattaches the socket or extension to the drive column, which is extremely inconvenient and inefficient.

Thus, a need exists for a ratchet wrench providing reliable, direct driving direction-switching operation and reliable positioning effect.

BRIEF SUMMARY OF THE INVENTION

The present invention solves this need and other problems in the field of reliable operation of reversing plates of ratchet wrenches by providing, in a preferred form, a ratchet wrench including a head and a handle interconnected to the head. The head includes first and second sides and a compartment defined between the first and second sides. The compartment includes a first compartment section and a second compartment section defined in an inner periphery of the first compartment section. The first compartment section has an opening in the second side. The first side of the head includes a hole in communication with the first compartment section. The first side of the head further includes a switch groove in communication with the second compartment section. A drive member is rotatably received in the first compartment section about a rotating axis. The drive member includes a coupling section. An engaging portion extends from an end of the coupling section and has a portion beyond the head through the hole. A drive column extends from the other end of the coupling section beyond the head through the opening. First and second pawls are slideably received in the second compartment section. Each of the first and second pawls includes a toothed face releasably engaged with the coupling section of the drive member. An elastic element is mounted between the first and second pawls to bias the first and second pawls away from each other to engage the toothed faces of the first and second pawls with the coupling section of the drive member. A switch includes a pivotal portion rotatably received in the switch groove about a pivoting axis. The switch further includes a follower portion having a pin. The pin has a spacing to the pivoting axis in a radial direction perpendicular to the pivoting axis. A reversing plate includes an end pivotably mounted to the portion of the engaging portion beyond the head between first and second operative positions about the rotating axis. The reversing plate includes a control section having a sliding groove extending in the radial direction. The pin is engaged in the sliding groove. The switch pivots in the switch groove with the pin sliding in the sliding groove when the reversing plate is moving between the first and second operative positions, controlling engagement between the coupling section of the drive member and the toothed faces of the first and second pawls.

When the reversing plate is in the first operative position, the toothed face of the second pawl is engaged with the coupling section of the drive member, and the toothed face of the first pawl is disengaged from the coupling section of the drive member, allowing the handle and the drive member to rotate in a first direction driving a fastener in the first direction, and allowing the handle to rotate freely relative to the drive member in a second direction reverse to the first direction without driving the fastener.

When the reversing plate is in the second operative position, the toothed face of the first pawl is engaged with the coupling section of the drive member, and the toothed face of the second pawl is disengaged from the coupling section of the drive member, allowing the handle and the drive member to rotate in the second direction driving the fastener in the second direction, and allowing the handle to rotate freely relative to the drive member in the first direction without driving the fastener.

In the most preferred form, the follower portion of the switch includes a positioning portion in the form of an axle extending beyond the first side of the head and coaxial to the pivoting axis. A positioning member in the form of a strip having three positioning grooves is mounted in a retaining groove of the control section. The axle engages with one of the positioning grooves to retain the reversing plate in one of three operative positions. The retaining groove has two sidewalls each having a notch. The strip is received in the retaining groove and has two ends engaged in the notches, allowing the strip to be deformable in the radial direction.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
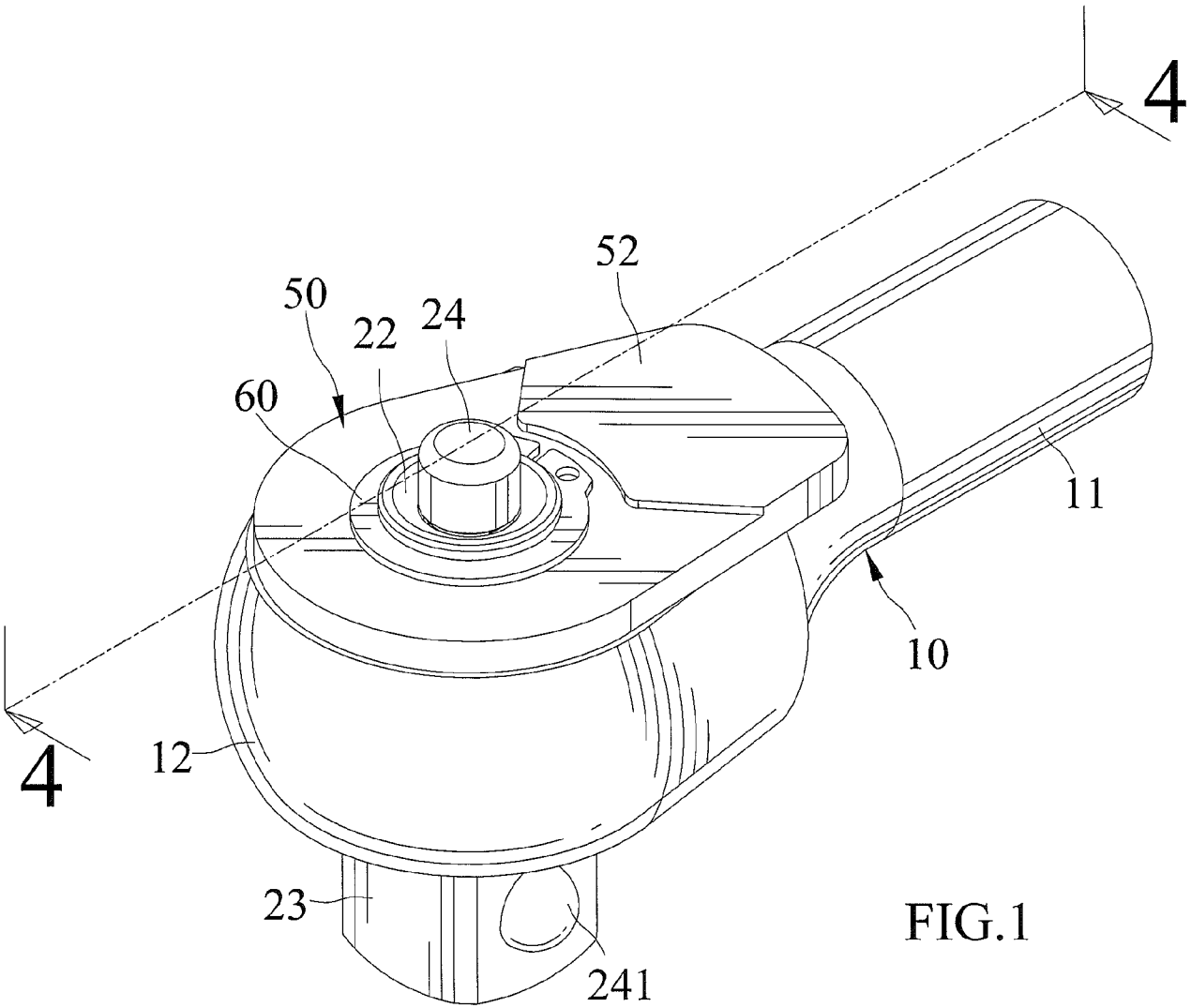
FIG. 1 shows a partial, perspective view of a ratchet wrench according to the preferred teachings of the present invention.
Figure 2:
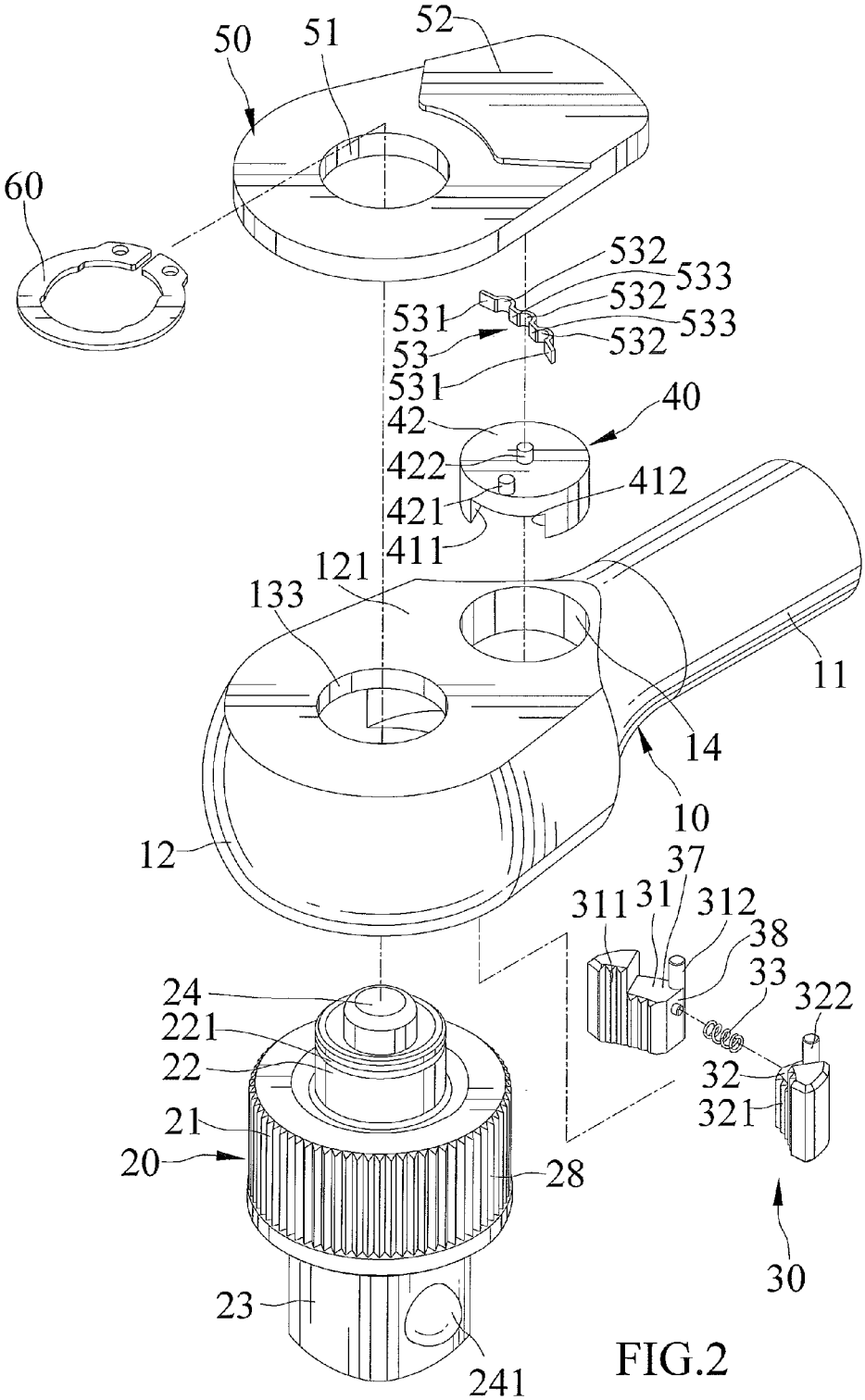
FIG. 2 shows a partial, exploded, top, perspective view of the ratchet wrench of FIG. 1.
Figure 3:
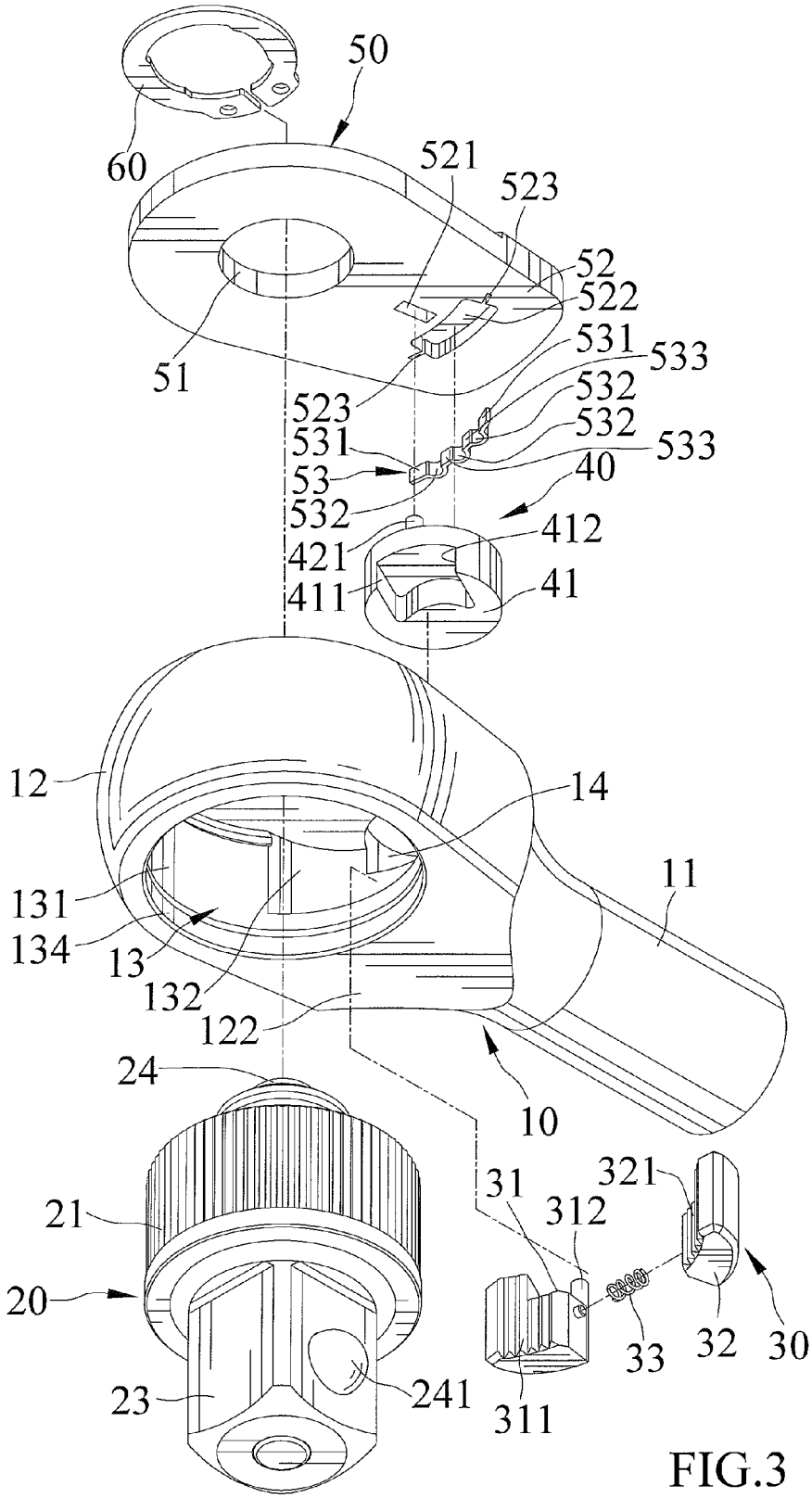
FIG. 3 shows a partial, exploded, bottom, perspective view of the ratchet wrench of FIG. 1.
Figure 4:
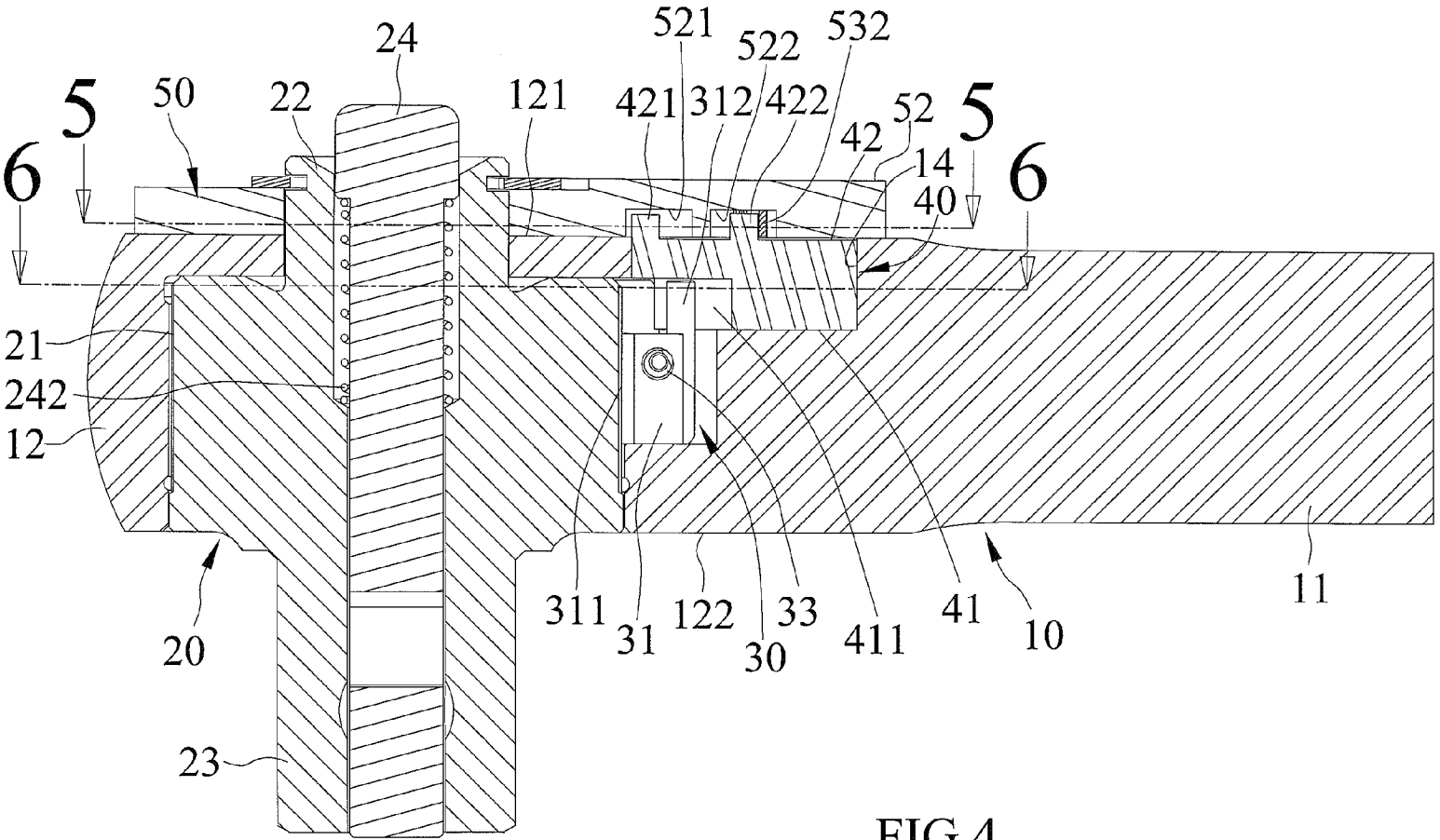
FIG. 4 shows a partial, cross sectional view of the ratchet wrench of FIG. 1 according to section line 4-4 of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "longitudinal", "radial", "lateral", "annular", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally designated 10. According to the preferred form shown, ratchet wrench 10 includes a handle 11 and a head 12 interconnected to handle 11. Head 12 includes a first side 121 and a second side 122 spaced from first side 121 in a thickness direction. A compartment 13 is defined between first and second sides 121 and 122. In the most preferred form shown, compartment 13 includes a larger, first compartment section 131 that has a longitudinal axis extending in the thickness direction and that is circular in cross section. First compartment section 131 has an opening 134 in second side 122. Compartment 13 further includes a smaller, second compartment section 132 defined in an inner periphery of first compartment section 131. Second compartment section 132 is crescent in cross section. First side 121 includes an end wall having a hole 133 in communication with and coaxial to first compartment section 131. First side 121 further includes a switch groove 14 in communication with an end of second compartment section 132 opposite to the other end of second compartment section 132 contiguous to first compartment section 131. Switch groove 14 defines a switching axis substantially parallel to the longitudinal axis of first compartment section 131.

According to the preferred form shown, a drive member 20 is rotatably received in first compartment section 131 of head 12 about a rotating axis coaxial to the longitudinal axis of first compartment section 131. Drive member 20 includes a coupling section 21 having a plurality of teeth 28 in an outer periphery thereof. An engaging portion 22 extends from an end of coupling section 21 beyond head 12 through hole 133 and includes an annular groove 221 in a distal end thereof. A drive column 23 extends from the other end of coupling section 21 beyond head 12 via opening 134. In the most preferred form shown, drive column 23 includes a hole receiving a ball 241. Drive member 20 further includes a central through-hole extending from engaging portion 22 through drive column 23 and in communication with the hole of drive column 23. A pushpin 24 is extended through the central through-hole and can be pushed to allow movement of ball 241 in the hole of drive column 23 for disengaging drive column 23 from a socket or the like. A spring 242 is provided to return push pin 24. Drive member 20 of other forms can be utilized according to the teachings of the present invention.

According to the preferred form shown, a pawl device 30 includes first and second pawls 31 and 32 slideably received in second compartment section 132 of head 12. Each of first and second pawls 31, 32 includes an inner, toothed face 311, 321 releasably engaged with teeth 28 of drive member 20. Each of first and second pawls 31 and 32 further includes a top face 37 transverse to toothed face 311, 321. A first coupling portion 312 in the most preferred form shown as a peg is formed on an inner end of top face 37 of first pawl 31. A second coupling portion 322 in the most preferred form shown as a peg is formed on an inner end of top face 37 of second pawl 32. Each of first and second pawls 31 and 32 further includes an end face 38 transverse to top face 37 and to toothed face 311, 321. An elastic element 33 in the most preferred form shown as a spring is mounted between end faces 38 of first and second pawls 31 and 32. Elastic element 33 biases first and second pawls 31 and 32 away from each other to engage toothed faces 311 and 321 of first and second pawls 31 and 32 with teeth 28 of drive member 20. Coupling portions 32 of other forms can be utilized according to the teachings of the present invention.

According to the preferred form shown, a switch 40 includes a pivotal portion 41 rotatably received in switch groove 14 and defining a pivoting axis coaxial to the switching axis of switch groove 14. Pivotal portion 41 includes first and second actuating sections 411 and 412 in the most preferred form shown as two lateral walls of a groove formed in an underside of switch 40. Switch 40 further includes a follower portion 42 having a top face flush with first side 121 of head 12. Follower portion 42 includes a pin 421 extending from the top face beyond first side 121. Pin 421 defines an axis parallel to the pivoting axis of switch 40 and having a spacing to the pivoting axis in a radial direction perpendicular to the pivoting axis. Follower portion 42 further includes a positioning portion 422 extending from the top face beyond first side 121. In the most preferred form shown, positioning portion 422 is in the form of an axle coaxial to the pivoting axis of switch 40.

According to the preferred form shown, ratchet wrench 10 further includes a reversing plate 50 having a hole 51 defining an axis coaxial to the rotating axis so that reversing plate 50 can be rotatably mounted around a portion of engaging portion 22 of drive member 20 beyond first side 121 of head 12. A retainer ring 60 is engaged in annular groove 221 of engaging portion 22 and rests on top of reversing plate 50 to prevent drive member 20 and reversing plate 50 from disengaging from head 12 while allowing rotating movement of reversing plate 50. Reversing plate 50 is pivotable between first, second, and third operative positions about the rotating axis of drive member 20. Reversing plate 50 further includes a control section 52 on an end thereof. According to the most preferred form shown, control section 52 includes an underside having a retaining groove 522 extending in a circumferential direction about the axis of hole 51. Retaining groove 522 includes two sidewalls each having a notch 523. The underside of control section 52 further includes a sliding groove 521 intermediate retaining groove 522 and hole 51 in a radial direction perpendicular to the axis of hole 51. Sliding groove 521 extends in the radial direction perpendicular to the axis of hole 51. Pin 421 of switch 40 is slideably engaged in sliding groove 521.

According to the preferred form shown, ratchet wrench 10 further includes a positioning member 53 in the most preferred form shown as a resilient metal strip having two ends 531 engaged in notches 523. The strip includes first, second, and third positioning grooves 532 in a side thereof. First, second, and third positioning grooves 532 are arcuate and intermediate ends 531 of the strip, allowing deformation of strip in the radial direction. Third positioning groove 532 is intermediate first and second positioning grooves 532. A rectilinear guiding portion 533 is formed between two adjacent positioning grooves 532 and has a spacing to the axis of hole 51 smaller than positioning grooves 532. Thus, guiding portions 533 can apply force to guide positioning portion 422 of switch 40 into one of first, second, and third positioning grooves 533.

Figure 5:
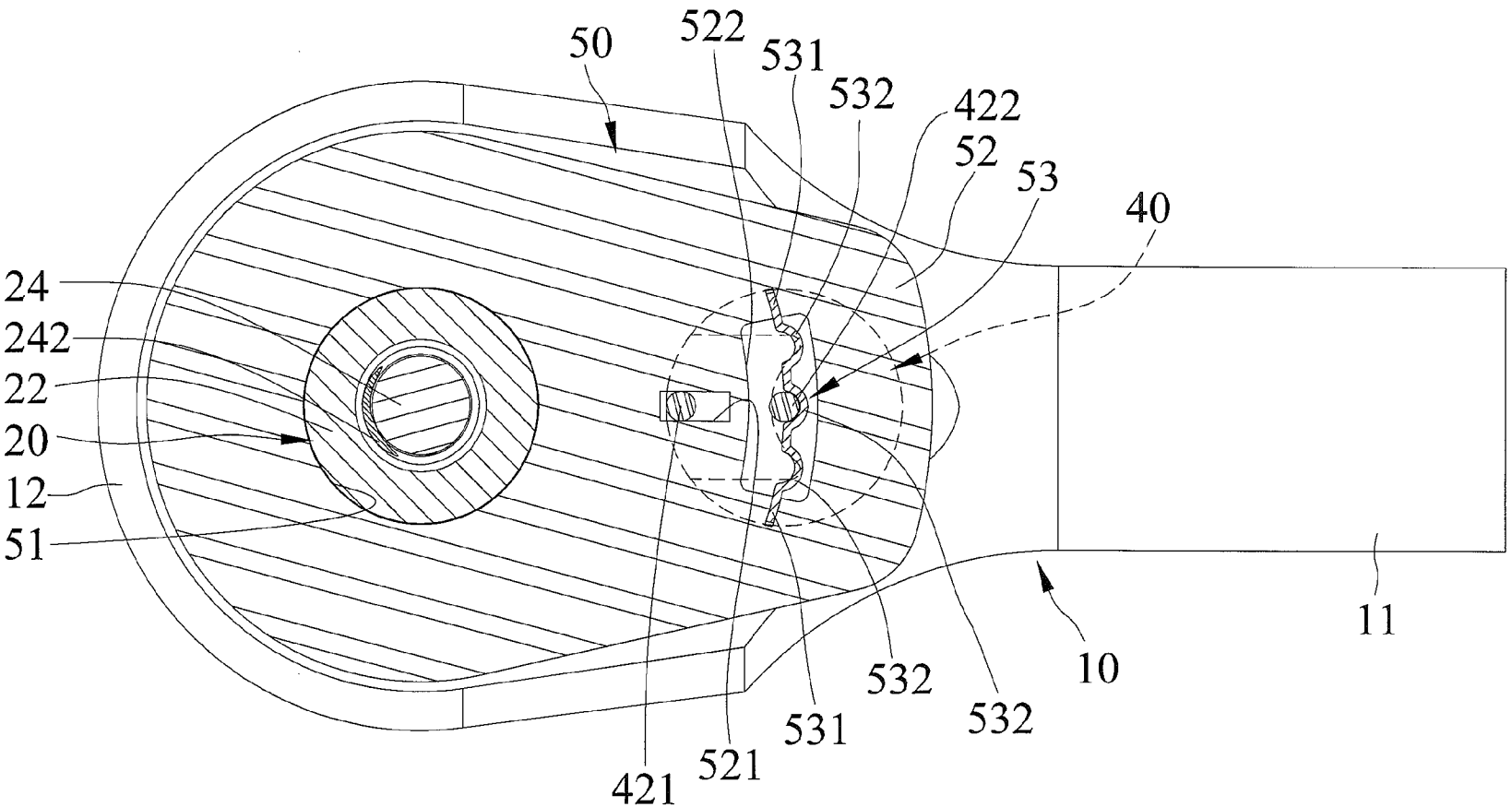
FIG. 5 shows a partial, cross sectional view of the ratchet wrench of FIG. 1 according to section line 5-5 of FIG. 4 with a reversing plate in a third operative position.
Figure 6:
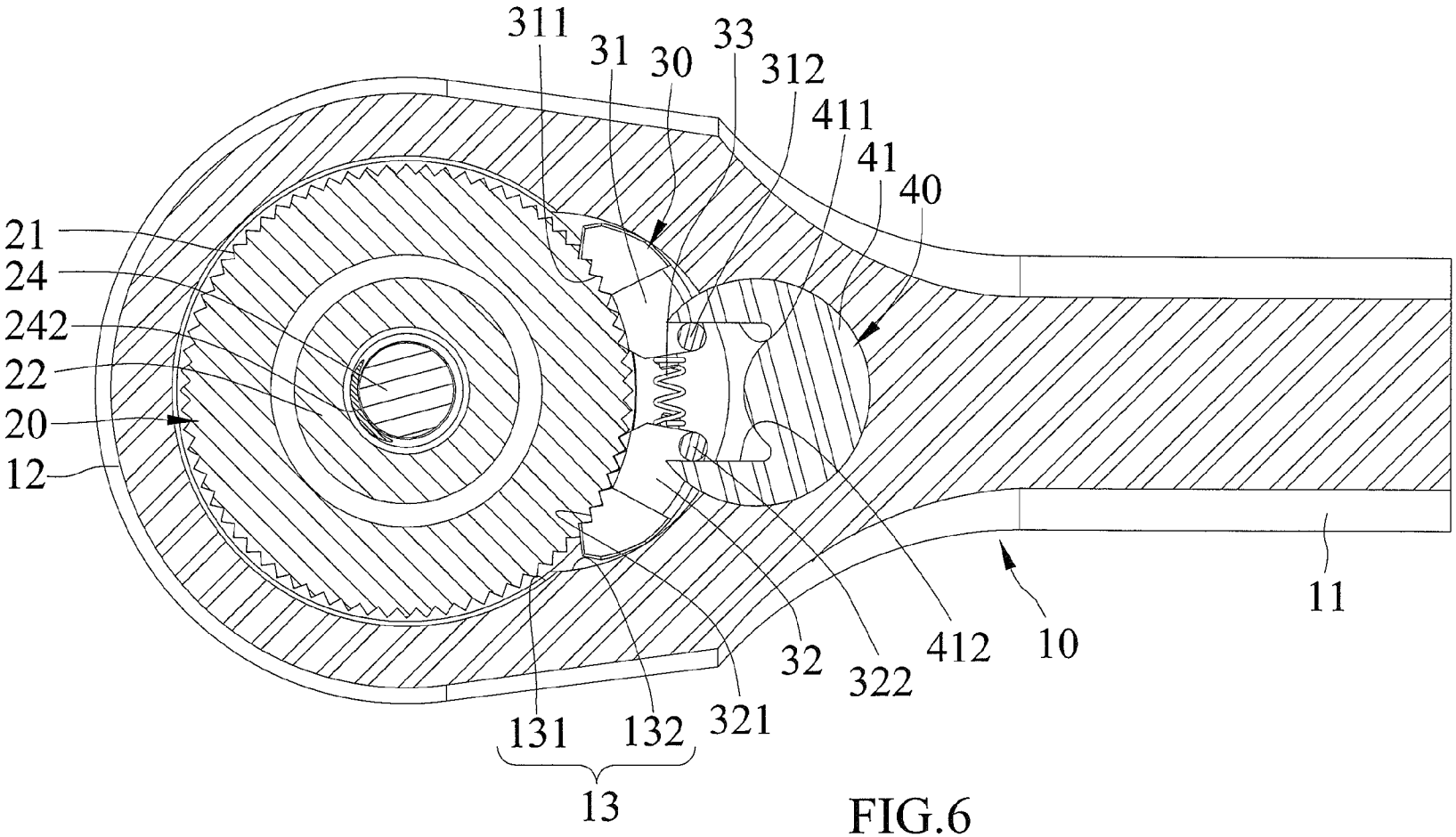
FIG. 6 shows a partial, cross sectional view of the ratchet wrench of FIG. 1 according to section line 6-6 of FIG. 4 with the reversing plate in the third operative position.

Now that the basic construction of ratchet wrench 10 of the preferred teachings of the present invention has been explained, the operation and some of the advantages of ratchet wrench 10 can be set forth and appreciated. In particular, for the sake of explanation, it will be assumed that reversing plate 50 is initially in the third operative position (FIGS. 5 and 6) intermediate the first and second operative positions. Positioning portion 422 is received in third positioning groove 532. Coupling portions 312 and 322 of first and second pawls 31 and 32 are located between first and second actuating sections 412 of switch 40. Furthermore, toothed portion 311, 321 of each of first and second pawls 31 and 32 is engaged with teeth 28 of drive member 20, allowing handle 11 and drive member 20 to rotate jointly in either of clockwise and counterclockwise directions to drive a fastener in the same direction. Free rotation of handle 11 relative to drive member 20 in either direction without driving the fastener is not allowed. Minor adjustment in tightening/loosening of the fastener can be achieved easily when reversing plate 50 is in the third operative position.

Figure 7:
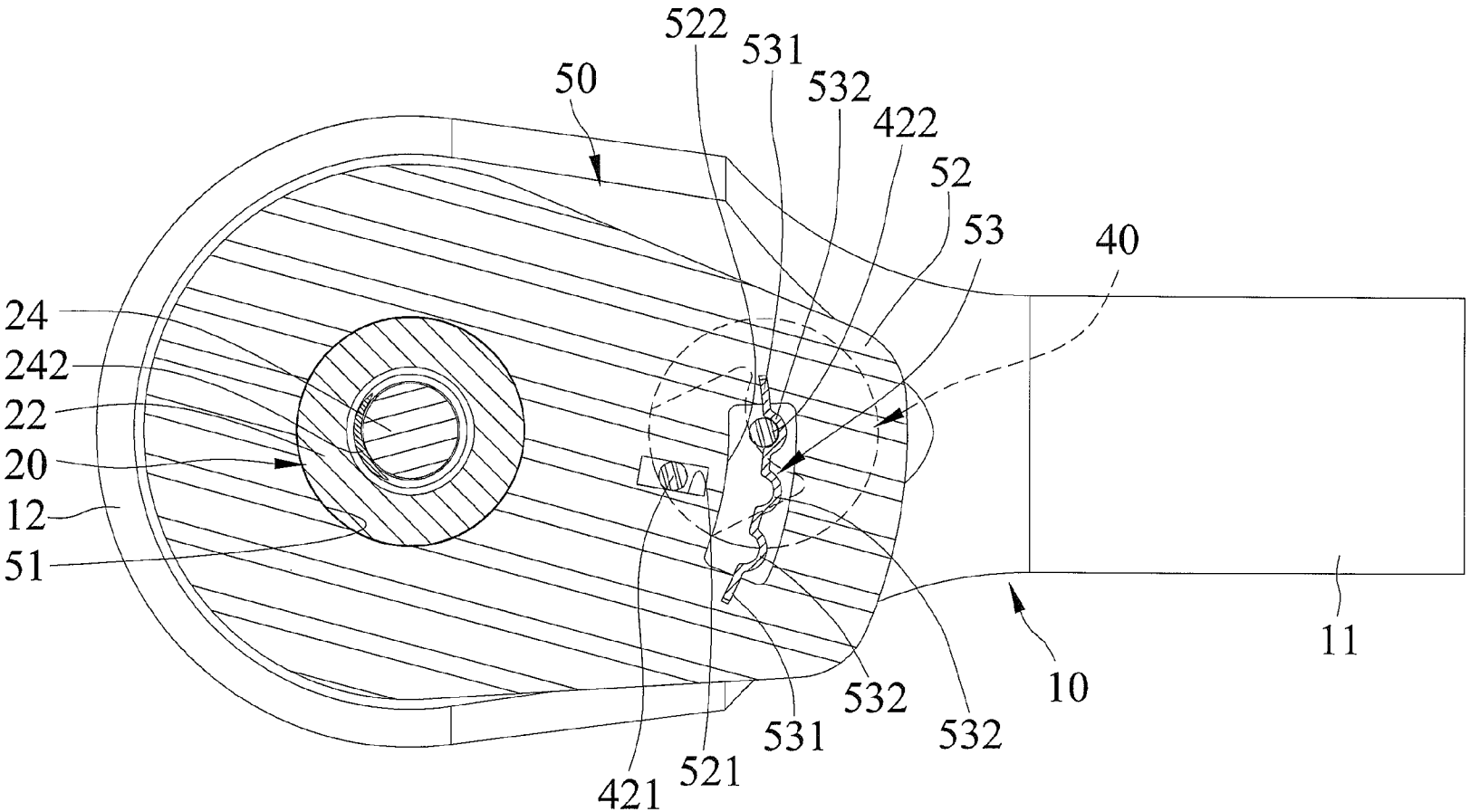
FIG. 7 shows a partial, cross sectional view similar to FIG. 5 with the reversing plate in a first operative position.
Figure 8:
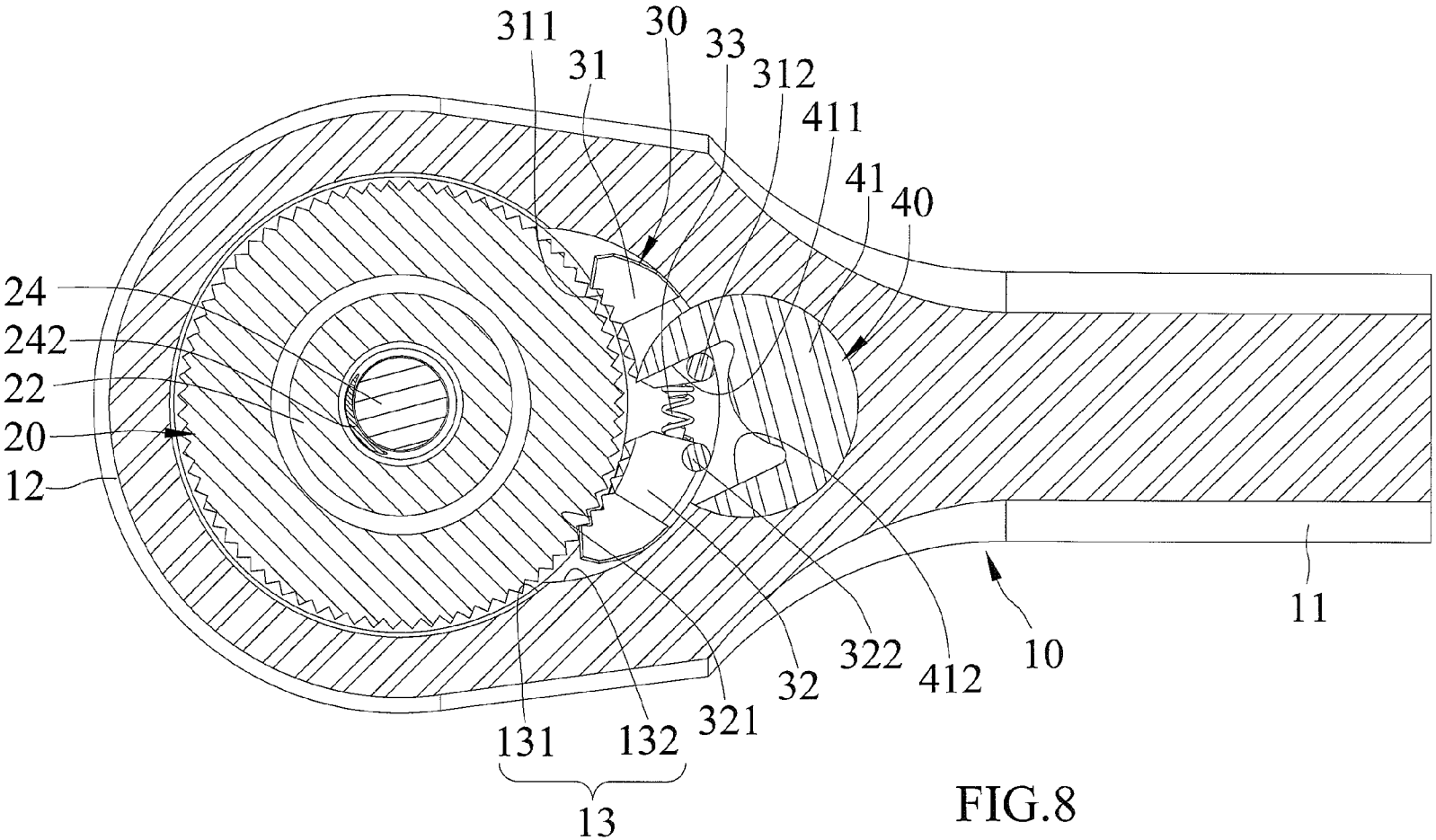
FIG. 8 shows a partial cross sectional view similar to FIG. 6 with the reversing plate in the first operative position.

When reversing plate 50 is pivoted from the third operative position to the first operative position (FIGS. 7 and 8), switch 40 pivots in switch groove 14 with pin 421 sliding in sliding groove 521. First actuating section 411 of switch 40 engages with and moves coupling portion 312 of first pawl 31. Thus, first pawl 31 is moved away from drive member 20. As a result, toothed portion 311 of first pawl 31 is disengaged from teeth 28 of drive member 20. Toothed portion 321 of second pawl 32 is still engaged with teeth 28 of drive member 20. Positioning portion 422 of switch 40 is received in first positioning groove 532. In this state, handle 11 and drive member 20 can rotate in the counterclockwise direction to drive the fastener in the counterclockwise direction. Furthermore, handle 11 can rotate freely in the clockwise direction relative to drive member 20 without driving the fastener.

Figure 9:
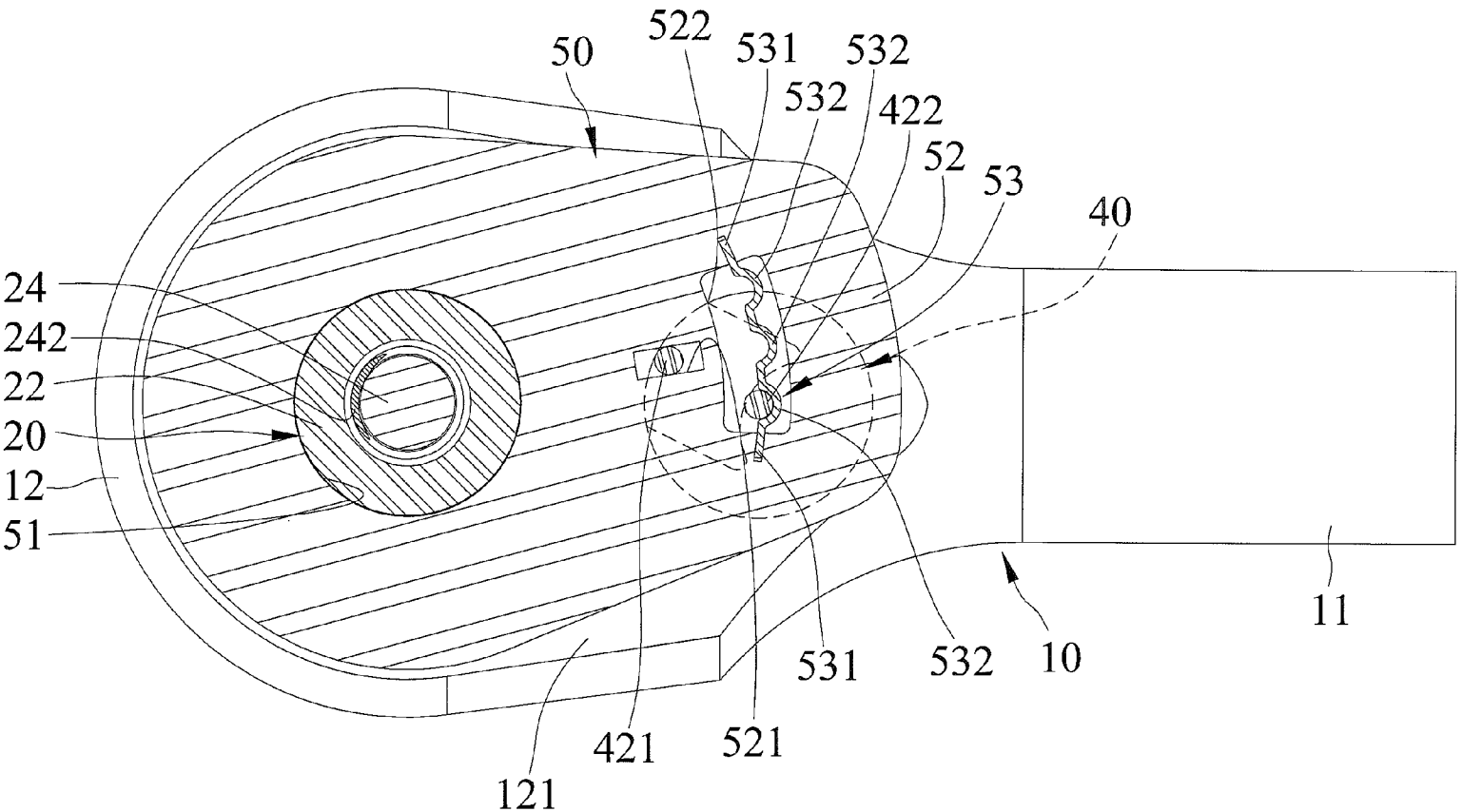
FIG. 9 shows a partial, cross sectional view similar to FIG. 5 with the reversing plate in a second operative position.
Figure 10:
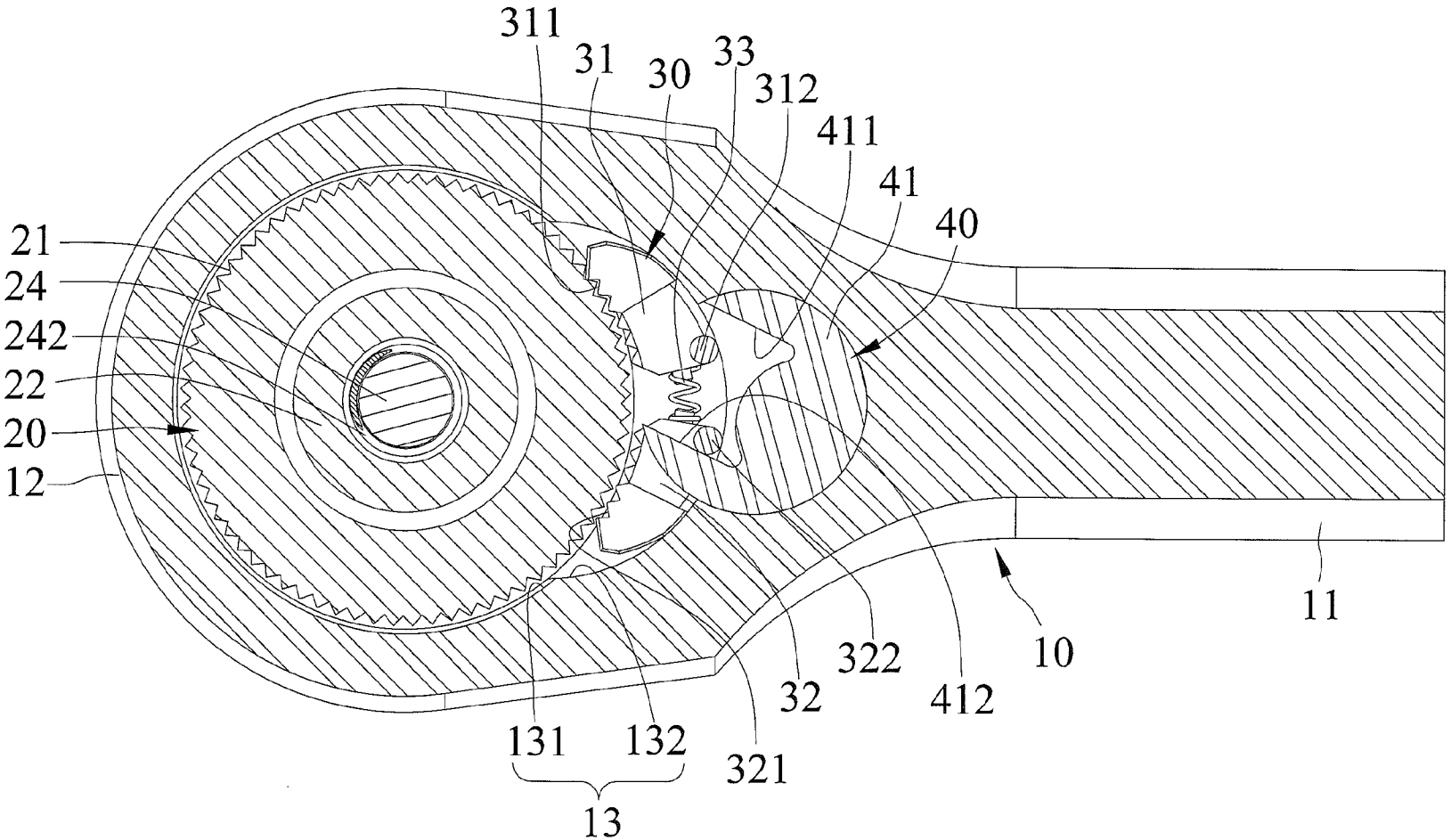
FIG. 10 shows a partial cross sectional view similar to FIG. 6 with the reversing plate in the second operative position.

When reversing plate 50 is moved from the third operative position to the second operative position (FIGS. 9 and 10), switch 40 pivots in switch groove 14 with pin 421 sliding in sliding groove 521. Second actuating section 412 of switch 40 engages with and moves coupling portion 322 of second pawl 32. Thus, second pawl 32 is moved away from drive member 20. As a result, toothed portion 321 of second pawl 32 is disengaged from teeth 28 of drive member 20. Toothed portion 311 of first pawl 31 is still engaged with teeth 28 of drive member 20. Positioning portion 422 is received in second positioning groove 532. In this state, handle 11 and drive member 20 can rotate in the clockwise direction to drive the fastener in the clockwise direction. Furthermore, handle 11 can rotate freely in the counterclockwise direction relative to drive member 20 without driving the fastener.

Since the underside of reversing plate 50 is in contact with first side 121 of head 12 adjacent engaging portion 22 of drive member 20, the switching between the first, second, and third operative positions of reversing plate 50 can be easily achieved even when drive column 23 of drive member 20 faces upward and when a socket or an extension is coupled to drive column 23. It can be appreciated that wear to reversing plate 50 resulting from friction between the underside of reversing plate 50 and first side 121 of rotating drive member 20 will not occur, allowing smoother operation of and prolonging the service life of reversing plate 50. Furthermore, the direction switching operation from reversing plate 50 to switch 50 is direct and reliable with high sensibility and less error. The number of elements used in ratchet wrench 10 according to the preferred teachings of the present invention is less than conventional designs by rotatably mounting an end of reversing plate 50 around drive member 20 and by providing a positioning member 53 in the other end of reversing plate 50 to actuate switch 40, reducing the manufacturing costs. Further, by providing positioning member 53 with three positioning grooves 532, formation of positioning structure in head 12 of ratchet wrench 10 according to the preferred teachings of the present invention is not required, further reducing the manufacturing costs.

Now that the basic teachings of the present invention have been explained, many extensions and variations will be obvious to one having ordinary skill in the art. For example, each of first and second pawls 31 and 32 can include a receptacle for receiving two ends of elastic element 33. Furthermore, positioning member 53 can include first and second positioning grooves 532, and reversing plate 50 can only be retained in the first and second operative positions. Other arrangements for engaging reversing plate 50 with switch 40 can be utilized according to the teachings of the present invention. As an example, sliding groove 521 can be formed in switch 40, and pin 421 can be formed on reversing plate 50. Furthermore, sliding groove 521 and pin 421 can have sizes and shapes other than those shown in the drawings.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a head and a handle interconnected to the head, with the head including first and second sides, with the head further including a compartment defined between the first and second sides, with the compartment including a first compartment section and a second compartment section defined in an inner periphery of the first compartment section, with the first compartment section having an opening in the second side, with the first side of the head including a hole in communication with the first compartment section, with the first side of the head further including a switch groove in communication with the second compartment section;

a drive member rotatably received in the first compartment section about a rotating axis, with the drive member including a coupling section, with an engaging portion extending from an end of the coupling section and having a portion beyond the head through the hole, with a drive column extending from another end of the coupling section beyond the head through the opening;

first and second pawls slideably received in the second compartment section, with each of the first and second pawls including a toothed face releasably engaged with the coupling section of the drive member, with an elastic element being mounted between the first and second pawls to bias the first and second pawls away from each other to engage the toothed faces of the first and second pawls with the coupling section of the drive member;

a switch including a pivotal portion rotatably received in the switch groove about a pivoting axis, with the switch further including a follower portion having a pin, with the pin having a spacing to the pivoting axis in a radial direction perpendicular to the pivoting axis; and a reversing plate including an end pivotably mounted to the portion of the engaging portion beyond the head between first and second operative positions about the rotating axis, with the reversing plate including a control section having a sliding groove extending in the radial direction, with the pin engaged in the sliding groove, with the switch pivoting in the switch groove with the pin sliding in the sliding groove when the reversing plate is moving between the first and second operative positions, controlling engagement between the coupling section of the drive member and the toothed faces of the first and second pawls, wherein when the reversing plate is in the first operative position, the toothed face of the second pawl is engaged with the coupling section of the drive member, the toothed face of the first pawl is disengaged from the coupling section of the drive member, allowing the handle and the drive member to rotate in a first direction driving a fastener in the first direction, and allowing the handle to rotate freely relative to the drive member in a second direction reverse to the first direction without driving the fastener, and wherein when the reversing plate is in the second operative position, the toothed face of the first pawl is engaged with the coupling section of the drive member, the toothed face of the second pawl is disengaged from the coupling section of the drive member, allowing the handle and the drive member to rotate in the second direction driving the fastener in the second direction, and allowing the handle to rotate freely relative to the drive member in the first direction without driving the fastener.

2. The ratchet wrench as claimed in claim 1, with the follower portion of the switch including a positioning portion extending beyond the first side of the head, with the ratchet wrench further including a positioning member mounted to the control section, with the positioning portion engaging with the positioning member to retain the reversing plate in one of the first and second operative positions.

3. The ratchet wrench as claimed in claim 2, with the positioning portion including an axle coaxial to the pivoting axis.

4. The ratchet wrench as claimed in claim 3, with the positioning member including a strip having first and second positioning grooves formed in a side of the strip, with the axle selectively engaged in one of the first and second positioning grooves to retain the reversing plate in one of the first and second operative positions.

5. The ratchet wrench as claimed in claim 4, with the positioning member further including a guiding portion formed between the first and second positioning grooves, with the guiding portion having a spacing to the rotating axis in the radial direction smaller than the first and second positioning grooves, and with the guiding portion guiding the axle into one of the first and second positioning grooves.

6. The ratchet wrench as claimed in claim 5, with the control section including a retaining groove having two sidewalls each having a notch, with the strip received in the retaining groove and having two ends engaged in the notches, with the strip deformable in the radial direction.

7. The ratchet wrench as claimed in claim 6, with the first pawl including a first coupling portion, with the second pawl including a second coupling portion, with the pivotal portion including first and second actuating sections respectively and releasably engaged with the first and second coupling portions of the first and second pawls, wherein when the reversing plate is in the first operative position, the first actuating section is engaged with the first coupling portion of the first pawl to disengage the toothed face of the first pawl from the coupling section of the drive member, wherein when the reversing plate is in the second operative position, the second actuating section is engaged with the second coupling portion of the second pawl to disengage the toothed face of the second pawl from the coupling section of the drive member.

8. The ratchet wrench as claimed in claim 7, with the reversing plate further including a third operative position intermediate the first and second operative positions, wherein when the reversing plate is in the third operative position, the toothed portions of the first and second pawls are engaged with the coupling section of the drive member, allowing the handle and the drive member to rotate in either of the first and second directions driving the fastener, and not allowing free rotation of the handle relative to the drive member in either of the first and second directions without driving the fastener.

9. The ratchet wrench as claimed in claim 8, with the strip further including a third positioning groove intermediate the first and second positioning groove, with the axle engaged in the third positioning groove when the reversing plate is in the third operative position.

10. The ratchet wrench as claimed in claim 4, with the pivotal portion including a groove having first and second lateral walls, with the first lateral wall engaging with the first pawl to disengage the toothed portion of the first pawl from the coupling portion of the drive member when the reversing plate is in the first operative position, with the second lateral wall engaging with the second pawl to disengage the toothed portion of the second pawl from the coupling portion of the drive member when the reversing plate is in the second operative position.

11. The ratchet wrench as claimed in claim 10, with the end of the reversing plate including a hole receiving the portion of the engaging portion of the drive member.

12. The ratchet wrench as claimed in claim 11, with the follower portion of the switch having a top face flush with the first side of the head.

* * * * *